United States Patent [19]

Nakamura et al.

[11] 4,013,531

[45] Mar. 22, 1977

[54] METHOD OF PRODUCING HIGH MOLECULAR FILM CONTAINING IONIZED MATERIAL

[75] Inventors: Kenichi Nakamura; Haruko Kakutani, both of Tokyo, Japan

[73] Assignee: Kureha Kagaku Kogyo Kabushiki Kaisha, Tokyo, Japan

[22] Filed: Mar. 24, 1976

[21] Appl. No.: 669,941

[30] Foreign Application Priority Data

Mar. 26, 1975 Japan .....50-35306

[52] U.S. Cl. ..... 204/180 R; 204/130; 204/181; 427/13; 427/55

[51] Int. Cl.[2] ..... C25D 1/18; C25D 13/06

[58] Field of Search ..... 204/2, 4, 6, 14 R, 14 N, 204/180 R, 299, 130, 181; 427/12, 13, 14, 26, 55

[56] References Cited

UNITED STATES PATENTS

| | | | |
|---|---|---|---|
| 3,145,156 | 8/1964 | Oster | 204/180 R |
| 3,372,102 | 3/1968 | Lennon | 204/181 |
| 3,409,528 | 11/1968 | Lennon | 204/180 R |
| 3,544,437 | 12/1970 | Loukes et al. | 204/180 R |
| 3,752,746 | 8/1973 | Castegnier | 204/130 |
| 3,892,568 | 7/1975 | Ota | 204/181 X |
| 3,896,016 | 7/1975 | Goodman et al. | 204/180 R |
| 3,933,609 | 1/1976 | Bokov et al. | 204/180 R |

*Primary Examiner*—Arthur C. Prescott
*Attorney, Agent, or Firm*—Sughrue, Rothwell, Mion, Zinn & Macpeak

[57] ABSTRACT

The ion distribution in a high molecular film is controlled by selectively altering the ion pattern under a combination of heat and electric field where at least one of the latter is applied to the film in the desired pattern. Selectively altering the ion pattern is accomplished by any one of the following: lateral shifting of ions in one film, removal of ions from one film and concurrent injection into a second film; removal of ion disassociative molecules from one film and concurrent injection into a second film. Ions which color the film are preferably used to permit visual inspection of the ion pattern. The film with the ion pattern is particularly adapted for electro-photographic copying.

29 Claims, 6 Drawing Figures

METHOD OF PRODUCING HIGH MOLECULAR FILM CONTAINING IONIZED MATERIAL

BACKGROUND OF INVENTION

The present invention relates to a method for forming a non-uniform ion districution pattern in a high molecular film, and more particularly, to a method of forming an image on a high molecular film by utilizing differences in ion density and conductivity between local areas of the film. It has been known for several years that electronic circuit elements can be produced by injecting ions into semiconductor or dielectric material. Such methods, however, require very large apparatus and the application of a high energy and a high electric field. The types of ion sources useful in such methods are limited, and it is also difficult to use the method to ionize organic high molecular materials because such materials are easily damaged by the high energy ions which are bombarded thereon.

SUMMARY OF THE INVENTION

The above disadvantages inherent to the prior technique can be overcome by the present invention. According to the present invention, ions are injected into, shifted in, or removed from a high molecular material without damaging the latter to form a pattern of ion distribution therein. The high molecular film is placed at a selected temperature, below the melting point thereof, for a short time in an electric field. The shape of the portion of the film wherein the ions are injected, shifted, or removed is controlled by controlling the shape of electrodes for producing the electric field or the shape of the pattern of applied heat by which the relatively low temperature is established.

Further, according to the present invention an image film can be formed by selectively injecting a colored ionic substance into a high molecular material film or selectively shifting and/or removing a colored ionic substance from the film to produce a variation in the optical property between portions of the film in which colored ionic substance is shifted and portions of the film in which colored ionic substance is unshifted.

DETAILED DESCRIPTION OF THE DRAWINGS

Figure 1:
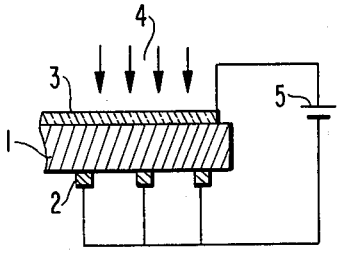
FIG. 1 shows an embodiment of the present method.

As used herein "ion injection" means a method wherein a high molecular film is brought in contact with ions, an ionizable substance, a film containing ionizable substances, or a solution containing such substances, and wherein the application of a suitable temperature and a suitable electric field causes ions to enter the film. When a uniform electric field is used, a suitable temperature pattern should be produced over the area of the film to achieve a pattern of ion distribution, and when a uniform temperature is applied a suitable electric field pattern should be applied. It is possible, however, to provide non-uniform distributions to both the temperature and the electric field.

As a method for producing the non-uniform distributions of the temperature and/or the electric field, it may be possible to make the shape of the electrodes for producing the electric field and/or the shape of the heater panel non-uniform. It is also possible to use a shield plate having desired shape between either one of the electrodes and the heater panel and the high molecular film.

The ion distribution pattern can also be accomplished by selective "ion removal" or "ion shifting" in a high molecular film which initially has a uniform ion distribution. Heat and electric field are applied as in the case of ion injection. In ion removal, a second high molecular film is sandwiched with the first, and the ions in the portions of the first film, which are subjected to the combination of heat and electric field, move from said portions of the first film into corresponding portions of the second film. In ion shifting, the ions in the portions subjected to the combined heat and electric field shift laterally.

The volume resistivities of a portion of the molecular film prepared by the present invention which contains relatively large amount of ions and a portion of the film which contains relatively small amount of ions vary according to the ion densities thereof and the dielectricities and conductivities of portions of the high molecular film. It is thus possible to produce an electric resistance distribution of the film in a range of, for example, from $10^{15}\Omega$cm to $10^{8}\ \Omega$cm or from $10^{10}\Omega$cm to $10^{5}\Omega$cm.

When colored ionic substances are used, the ion-containing high molecular film prepared according to the present invention become particularly suitable for use in image formation by using the surface pattern of electric conductivity created in between the film. In most of the known image forming methods utilizing a latent electrostatic image, the latent image disappears during the developing process. For this reason, when a plurality of copies are required, it is necessary to use initially a process of forming an image on a recording medium. In the film prepared according to the present invention the variation of the surface potential can be utilized for image formation and image recording. In this case, since a stable latent image is formed in the form of ion distribution, the film is corona-charged or charged by inserting it into a gap between electrodes and applying a voltage therebetween. An electrostatic latent image thus prepared can be developed by charged powder as in the conventional electro-photography. The electric property of the high molecular film having patterns formed by ions contained therein is stable for a long period of time and therefore can be used as a master plate for repeated development.

Additionally, complementary images, i.e., positive and negative, can be produced by sandwiching a uniformly ionized film and a non-ionized film and subjecting the combination to the heat and electric field pattern as previously described. In this case, the ions in the patterned area subjected to the combination of heat and temperature are removed from the first film and injected into the second film. Multiple pairs of complementary images can be formed by overlapping several film pairs.

The high molecular materials suitable for use in the present invention are those which are relatively easy to polarize. Furthermore high molecular materials having a low glass transition temperature and a low crystallization are suitable from the standpoint of the easiness of ion injection, ion shift and ion elimination. However, in order to maintain the film stable after formation of the ion pattern, it is preferrable that the crystallization be high. Examples of suitable high molecular films are halogenated polymer, polyester, synthetic rubber, acrylic resin, methacrylic resin or polystyrene etc. Also suitable are films containing polyvinylidene fluoride whose polarization is high and whose glass transition temperature is low. A mixture of these materials with various processing assistants and plasticizers may be utilized.

There are many ion sources which are suitable in practicing the present invention. However, colored ionic substances are especially desirable. Examples of suitable colored ionic substances include, basic dye, cationic dye and acidic dye etc. Particularly, basic dye such as Malachite Green, Rhodamine B and Methyl Violet, etc., are effective.

Several specific examples of the method of the present invention will now be described.

EXAMPLE 1

The first example, to be explained with reference to FIG. 1, involved ion shifting to form a pattern in the high molecular film. A 100 $\mu$ thick high molecular film 1 of polyvinylidene fluoride (PVDF) dispersed with Malachite Green (MG), of 0.01 mol%, was prepared according to conventional techniques so that the film had a uniform ionic distribution and a green color. A comb shaped electrode 2 and a glass electrode 3, e.g., a NESA electrode, were attached to the opposite surfaces of the film as shown. An electric field of 300 V/cm was applied between the electrodes by an external voltage source 5, and, simultaneously heat radiation 4 was directed uniformly onto the NESA electrode surface for 60 seconds by an infrared lamp, not shown. A discolored image corresponding to the shape of the comb electrode 2 was obtained on the high molecular film 1.

Figure 2:
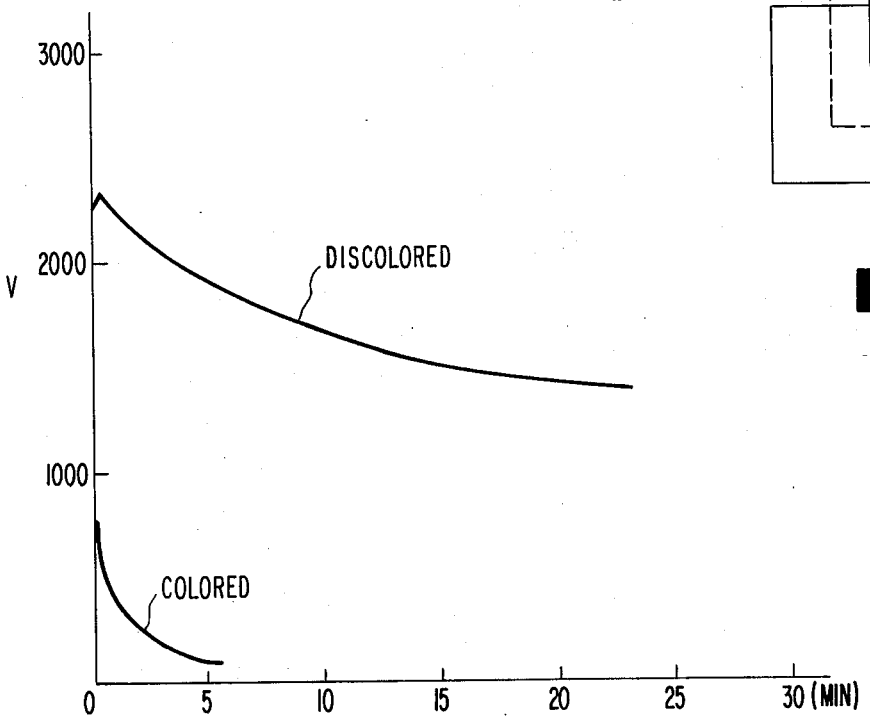
FIG. 2 is a graph showing a difference in attenuation of surface potential between a colored portion and a non-colored portion of a high molecular film.

FIG. 2 shows time variations of surface potential of the colored portion and the discolored portion of film 1, prepared by example 1, after the film was corona-charged.

The surface potential of the discolored portion remained at a high value, in a range from 2400 volts to 1000 volts, for several minutes or more. The surface potential of the colored portion was initially lower than that of the discolored portion, the value being 800 volts, and was attenuated to 100 volts or less after 5 minutes. This clearly shows the difference in the surface charge retention properties between the colored portions, i.e., portions having high ion concentration, and the discolored portions, i.e., the portions having a low ion concentration. By supplying colored and charged powder, the powder adhered only to the discolored portion, resulting in a colored image on the high molecular film. It was found that the process of charging and powder image formation can be repeated more than 100 times and the degradation of the transferred image obtained by each process is very small.

EXAMPLE 2

Figure 3:
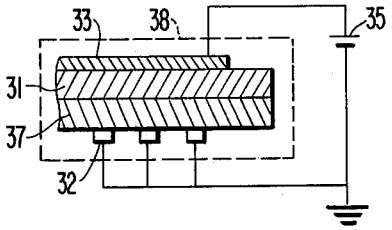
FIG. 3 is another embodiment of the present method.

Referring to FIG. 3 a high molecular, purple colored sheet 31, having a thickness of 50$\mu$, was prepared by conventionally mixing polyvinylidene fluoride (PVDF) and Rhodamine B (RB) of 0.2 mol% and roll-kneading and pressing the mixture. A transparent transfer film 37 of PVDF, the thickness being 50$\mu$, was put on one surface of the colored sheet 31 in stack formation as shown. A comb shaped electrode 32 and a plate like metal electrode 33 were attached on the opposite surfaces of the stack as the positive and negative electrodes, respectively, and the stack was inserted into an oven to maintain the temperature of the stack at 80° C. A d.c. voltage of 1.5 K volts was applied across the stack by an external voltage source 35 for 3 minutes. Thereafter the stack was withdrawn from the oven. The film 31 was discolored over an area corresponding to the form of the comb electrode and the corresponding portions of the PVDF film 37 were purple-colored by dye-injection from the film 31, resulting in the negative-positive images in the films 31 and 37, respectively. The resulting coloration-discoloration patterns indicates that the ions were removed from the comb shaped region of film 31 and injected into a comb shaped region of film 37.

EXAMPLE 3

Figure 4:
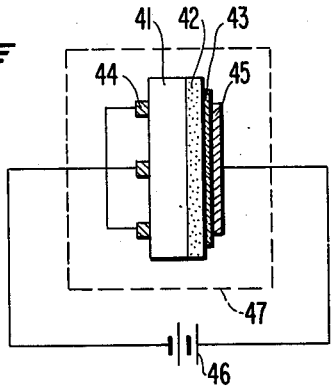
FIG. 4 is a further embodiment of the present invention.

As shown in FIG. 4, a film 41 of vinylidene chloride/vinylchloride coplymer having a thickness of about 50$\mu$, and a film 42 of PVDF having thickness of 6$\mu$ were stacked, and an aqueous solution of 0.01% Methyl Violet was painted onto the film 42 and dried thereafter to form a dye layer 43. On the film 41 a comb electrode 44 was provided, and on the dye layer 43 a plate electrode 45 was provided. The assembly was placed in an oven 47 and maintained at 85° C. In this state, a d.c. voltage of 100 K volts/cm was applied between the electrodes for about 60 seconds. Thereafter the temperature was lowered and the application of the d.c. voltage was terminated. The layer 42 was removed from the assembly and the film 41 was corona-charged. After a period of 1 minute, the surface potential of the portion of the film 41 which corresponds to the comb electrode 44 was as large as 5 to 20 times that of the remaining portion of the film.

EXAMPLE 4

Figure 5:
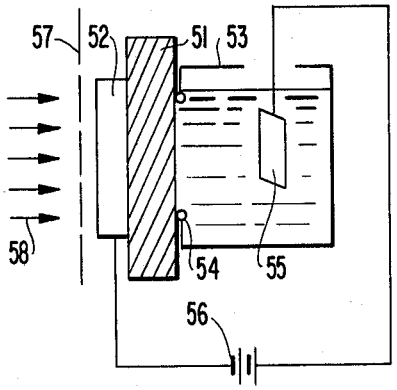
FIG. 5 is a still further embodiment of the present invention.

As shown in FIG. 5, a conductive glass electrode 52 was attached onto one surface of PVDF film 51 having thickness of 100$\mu$. A methacrylic resin cell 53 was placed adjacent the other side of film 51 with the side of the cell facing the film 51 through a side window. A silicone rubber packing member 54 was provided along the periphery of the side window to seal the contact between the PVDF film 51 and the cell 53. The cell 53 was filled with 5% potassium iodide aqueous solution, and a platinum electrode 55 was inserted therein.

A d.c. voltage of 500 volts was applied between the electrodes 52 and 55 from an external voltage source 56 and, simultaneously, heat radiation 58 was directed by an infrared lamp through a comb shaped mask into the electrode 52 for about three minutes. After the heat radiation and the voltage application were completed, the film 51 was dried. The volume resistivity of the unmasked portion of the film was about $10^{11}\Omega$.cm and that of the masked portion was about $10^{14}\Omega$.cm.

EXAMPLE 5

Figure 6:
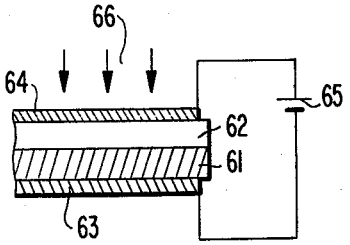
FIG. 6 is another embodiment of the present invention.

As shown in FIG. 6, a film 61 of vinylidene chloride/vinyl chloride copolymer, having a thickness of 50$\mu$, and a PVDF film 62 containing 0.02 mol% Rhodamine B, and having a thickness of 50$\mu$, were stacked and sandwiched by a metal electrode 63 and a Nesa electrode 64. A d.c. electric field of 1000V/cm was applied from an external source between the electrodes and simultaneously a thermal pattern 66 was projected by an infrared lamp onto the Nesa electrode 64. After the heat and voltage applications were completed, the film 61 was colored with a pattern corresponding to the thermal pattern 66 and the film 62 had the reverse coloration-descoloration pattern. The films 61 and 62 were corona-charged as in Example 1, and colored and charged powder was sprayed onto both film. The powder adhered only to the discolored portions, resulting in a negative and a positive images on the films 61 and 62, respectively.

EXAMPLE 6

A 50u thick PVC-MG film was prepared by combining 100 parts of polyvinyl chloride, 50 parts of plasticizer and 0.05 mol% Malachite Green. A 25$\mu$ thick nylon 6 film was stacked on the PVC-MG film and the stack was sandwiched by a NESA electrode and a comb electrode. A voltage of 1000 volts was applied between the electrodes and the lamination was irradiated with heat for 30 seconds. After the voltage application and the heat irradiation were completed, the PVC-MG sheet was discolored with the comb pattern and the nylon 6 film was colored green correspondingly.

EXAMPLE 7

The procedure was the same as Example 6 except that a polyester film of 20u thick was substituted for the nylon 6 film. The PVC-MG film was discolored with the comb pattern and the polyester film was colored correspondingly.

What is claimed is:

1. A method of forming in a high molecular film a non-uniform distribution of the volume concentration of ions of an ion dissassociative substance comprising the steps of, preparing said high molecular film with a substantially uniform distribution of volume concentration of ions therein, heating said film to a temperature which is lower than the melting point of said film and simultaneously applying an electric field across said layer in amounts and for a time sufficient to cause ion movement in said film away from regions receiving the combined heat and electric field, at least one of said heat and electric field being applied in a surface pattern corresponding to the desired non-uniform distribution pattern.

2. The method of claim 1 wherein said electric field is applied to said film by electrodes on the opposite surfaces thereof, one of said electrodes being shaped in the pattern of said non-uniform distribution pattern.

3. The method of claim 2 wherein the other of said electrodes is a light transparent electrode, and heat is applied by directing infrared light through said transparent electrode onto said film.

4. The method of claim 1 further comprising a second high molecular film having a uniform volume concentration of said ions from substantially below that of said first film to zero concentration, said first and second films being stacked so as to have one surface in common, said application of heat and electric field being applied to said combined layers whereby ions in a patterned area are removed from said first film and enter a corresponding patterned area of said second film.

5. The method of claim 4 wherein the step of applying heat comprises directing infrared light through a patterned mask onto the surface of said first layer not in common with the second layer.

6. The method of claim 4 wherein the step of applying an electric field comprises applying a voltage between a first electrode in contact with the non-common surface of said first film and a second electrode in contact with the non-common surface of said second film, said second electrode having a shape corresponding to said non-uniform distribution pattern.

7. The method of claim 6 wherein the step of applying heat comprises placing the combined first and second films in an oven.

8. The method of claim 1 wherein said high molecular film is a material selected from the group consisting of halogenated polymers, polyesters, synthetic rubber, acrylic resin, methacrylic resin, polystyrene, and films containing polyvinylidene fluoride.

9. The method of claim 8 wherein said ion dissassociative substance is basic dye.

10. The method of claim 8 wherein said ion disassociative substance is a basis dye selected from the group consisting of malachite green, Rhodamine B methyl violet.

11. The method of claim 1 wherein said high molecular film is a film of polyvinylidene fluoride.

12. The method of claim 11 wherein said ion disassociative substance is a basic die selected from the group consisting of malachite green, Rhodamine B, and methyl violet.

13. The method of claim 4 wherein said first and second films are films selected from the group consisting of halogenated polymers, polyesters, synthetic rubber, acrylic resin, methacrylic resin, polystyrene, and films containing polyvinylidene fluoride.

14. The method of claim 13 wherein said ion disassociative substance is basic dye.

15. The method of claim 13 wherein said ion disassociative substance is a basis dye selected from the group consisting of malachite green, Rhodamine B, and methyl violet.

16. The method of claim 4 wherein said high molecular film is a film of polyvinylidene fluoride.

17. The method of claim 16 wherein said ion disassociative substance is basic die selected from the group consisting of malachite green, Rhodamine B, and methyl violet.

18. A method of forming in a high molecular film a non-uniform distribution of the volume concentration of ions of an ion disassociative substance comprising the steps of, placing a source of said ions in contact with one surface of said film, applying heat at a temperature below the melting point of said film and an electric field to said film and said source in amounts and for a time sufficient to cause ions to move from said source into said film, at least one of said application of heat and application of electric field being carried out in a surface pattern to result in said non-uniform distribution.

19. The method of claim 18 wherein said source of ions is a liquid methacrylic cell having an opening therein through which said liquid is in contact with one surface of said film.

20. The method of claim 19 wherein the step of applying said electric field comprises the step applying a voltage between a first electrode in contact with the surface of said film which is not contacting said liquid and a second electrode immersed in said liquid.

21. The method of claim 20 wherein said first electrode is transparent to infrared light and wherein the step of applying heat comprises directing infrared light through said transparent electrode onto a surface of said film.

22. The method of claim 19 wherein said film is a polyvinylidene fluoride film.

23. A method of forming in a high molecular film a non-uniform distribution of the volume concentration of ions of an ion dissassociative substance comprising the steps of, placing a second high molecular film much thinner than said first film in stacked contact with said first film, applying a coating of an ion dissassociative substance on the surface of said second film which is not in contact with said first film, applying heat at a temperature below the melting point of said film and an electric field to said stacked films and substance in amounts and for a time sufficient to cause ions to move from said source into said film, at least one of said application of heat and application of electric field being carried out in a surface pattern to result in said non-uniform distribution.

24. The method of claim 23 wherein the step of applying an electric field comprises applying a voltage between a first electrode in contact with the surface of said coating that is not contacting said second film and a second electrode in contact with the surface of said first film that is not contacing said second film, said second electrode having a shape corresponding to said ion distribution pattern.

25. The method of claim 23 wherein said first high melecular film is a film selected from the group consisting of halogenated polymers, polyesters, synthetic rubber, acrylic resin, methacrylic resin, polystyrene, and films containing polyvinyledene fluoride.

26. The method of claim 25 wherein said ion disassociative substance is a basic die.

27. The method of claim 25 wherein said ion disassociative substance is basic dye selected from the group consisting of malachite green, Rhodamine B and methyl violet.

28. The method of claim 27 wherein said second high molecular film is a film selected from the group consisting of halogenated polymers, polyesters, synthetic rubber, acrylic resin, methacrylic resin, polystyrene, and films containing polyvinylidene fluoride.

29. The method of claim 23 wherein said first and second films are polyvinylidene fluoride films and said ion disassociative substance is methyl violet.

* * * * *